US006089070A

United States Patent [19]

Hancock et al.

[11] Patent Number: 6,089,070

[45] Date of Patent: Jul. 18, 2000

[54] METHOD OF MANUFACTURING A METAL WOOD GOLF CLUB HEAD

[75] Inventors: Warren Colin Hancock, Diamond Creek; Michael Alan Northwood, Donvale, both of Australia

[73] Assignee: Super Alloy Technologies Pty Ltd., Victoria, Australia

[21] Appl. No.: 08/932,501

[22] Filed: Sep. 18, 1997

Related U.S. Application Data

[63] Continuation-in-part of application No. 08/707,503, Sep. 4, 1996, abandoned.

[30] Foreign Application Priority Data

Sep. 6, 1995 [AU] Australia ..... PN 5255

[51] Int. Cl.[7] ..... B21K 17/00

[52] U.S. Cl. ..... 72/340; 72/342.1; 72/343; 473/345

[58] Field of Search ..... 72/340, 343, 342.1, 72/342.94; 473/324, 345, 343

[56] References Cited

U.S. PATENT DOCUMENTS

| | | | |
|---|---|---|---|
| 4,432,549 | 2/1984 | Zebelean | 273/167 |
| 4,438,931 | 3/1984 | Motomiya | 273/167 |
| 5,028,049 | 7/1991 | McKeighen | 273/167 |
| 5,106,094 | 4/1992 | Desbiolles et al. | 273/167 |
| 5,205,560 | 4/1993 | Hoshi et al. | 273/167 |
| 5,232,224 | 8/1993 | Zeider | 273/167 |
| 5,346,217 | 9/1994 | Tsuchiya et al. | 273/167 |
| 5,350,556 | 9/1994 | Abe et al. | 264/248 |
| 5,485,998 | 1/1996 | Kobayashi | 273/80.2 |
| 5,516,107 | 5/1996 | Okumoto et al. | 473/346 |
| 5,518,240 | 5/1996 | Igarashi | 473/345 |
| 5,518,242 | 5/1996 | Mahaffey | 473/342 |
| 5,527,034 | 6/1996 | Asheraft et al. | 473/330 |
| 5,533,729 | 7/1996 | Leu | 473/346 |
| 5,788,584 | 8/1998 | Parente | 473/290 |
| 5,797,807 | 8/1998 | Moore | 473/345 |
| 5,851,159 | 12/1998 | Burrows | 473/345 |

*Primary Examiner*—Daniel C. Crane
*Attorney, Agent, or Firm*—Baker & Daniels

[57] ABSTRACT

This invention relates to an improved golf club head and an improved method of manufacturing of a golf club head. More particularly, the invention relates to an improved metal wood golf club head and improved method of manufacturing a metal wood golf club head. The invention provides a metal wood golf club head including a one piece precision hot forged body portion comprising a hosel, a sole and a hitting face. The invention also provides a method of manufacturing a metal wood golf club head including the step of integrally forming a body portion of the club head comprising a hosel, a sole and a hitting face. The body portion of the club head is made by precision hot forging a billet of material, particularly titanium or alloys thereof, or alternatively, aluminium or alloys thereof.

13 Claims, 1 Drawing Sheet

METHOD OF MANUFACTURING A METAL WOOD GOLF CLUB HEAD

CROSS REFERENCE TO RELATED APPLICATIONS

This is a continuation-in-part of application Ser. No. 08/707,503 filed Sep. 4, 1996, now abandoned.

FIELD OF THE INVENTION

This invention relates to an improved golf club head and an improved method of manufacturing of a golf club head. More particularly, the invention relates to an improved metal wood golf club head and improved method of manufacturing a metal wood golf club head.

BACKGROUND OF THE INVENTION

Metal wood golf club heads have become increasingly popular over the past twenty to thirty years with the improvement of metal casting techniques. It has been discovered that metal woods provide an increase in the accuracy and length of a given golf shot when compared with the traditional woods made of wood.

To date most metal wood manufacturers have used a casting process, wherein the casting process has produced the head in a number of pieces and in particular, two components including a sole plate and a head shell comprising the hitting face, hosel and top or crown portion. The problem with casting is that metal casting techniques inherently produce a variety of surface imperfections, which must be removed prior to sale, but require considerable time and effort to do so. Another problem with casting is that the wood design and in particular the relationship between the hosel and the hitting face and sole arrangement cannot be easily and economically varied when a casting process is used since a change in the die is required for each variation.

Some attempts have been made to address the problems of casting by stamping the club head components from sheet metal. One example of this process is described in U.S. Pat. No. 5,232,224 in the name of Zeider. This patent discloses a method of forming a metal wood club head from four separate components, wherein the components including the head base, face plate and crown plate, have been stamped out of metal sheet, and also including a hosel tube. The components are welded together, wherein the head base can be machined to allow the face plate to be attached at different angles, resulting in clubs with different loft angles. Additionally, because the hosel is a separate piece the angle of fixing can also be varied. The problem with manufacturing golf club heads in this manner is that the components are extremely difficult, time consuming and thus costly to align and require special jigs to accurately align the components relative to each other and in particular correctly align the hosel relative to the other components.

Furthermore if the hosel, and thus the centre line of the shaft that fits into the hosel, is not perfectly aligned with the hitting face and sole of the club, the player will not be able to accurately align the hitting face with the ball, resulting in a larger than usual number of wayward shots.

Thus, it is the object of the present invention to provide a method of manufacturing of a metal wood golf club head which addresses some of the problems of the prior art. It is also an object of the present invention to provide a metal wood golf club head made by the improved method.

SUMMARY OF THE INVENTION

To this end, one aspect of the present invention provides a metal wood golf club head including a one piece impression forged body portion comprising a hosel, a sole and a hitting face.

Another aspect of the present invention provides a method of manufacturing a metal wood golf club head including impression forging a one piece body portion of the golf club head at an elevated temperature, said one piece body portion including a hosel, a sole and a hitting face.

The body portion of the club head is made by impression (or "precision") forging metal at an elevated temperature. Preferred metals are titanium or alloys thereof, or aluminium or alloys thereof (particularly 7075 aluminium alloy). Most preferably, the body portion is made of forged titanium.

Preferably the golf club head is manufactured as a two-piece club head wherein a top, or crown, portion is fixed to the forged body portion so as to form a complete golf club head.

The accuracy of finish of the body portion may be further enhanced by machining of the hitting face and/or hosel portions after the forging has been completed. Preferably the machining is performed by way of CNC (Computer Numerical Control) milling. With this additional machining the bulge and roll of the hitting face can be controlled to within ±0.03 millimeters. Furthermore, the critical relationship between the hitting face and the hosel can be accurately controlled to provide superior repeatability. The loft, lie and face angles of the club head can be controlled to within ±0.25 degrees, whereas the current art provides accuracy of only ±2 degrees. This improvement in accuracy of finish results in increased hitting distances and lower dispersion characteristics.

Advantageously, the invention provides a method which results in producing a golf club that is simple to assemble, yet precisely aligned. In particular, by integrally forming the hosel, the hitting face and the sole as one piece, this provides control over the geometric tolerance and specification of the loft and lies, open/close face position in relationship with the centre line of the hosel bore. Thus by controlling this relationship, this allows the player using the club to align perfectly.

Furthermore, by providing an integrally formed body portion, the resulting golf club head is surprisingly strong and is found to be much structurally stronger than cast heads and existing three or four component wood heads which require considerable welding together. Moreover the strength to weight ratio of a club head made in accordance with the present invention is considerably higher than the same club head made in accordance with known processes.

DETAILED DESCRIPTION OF THE INVENTION

Figure 2:
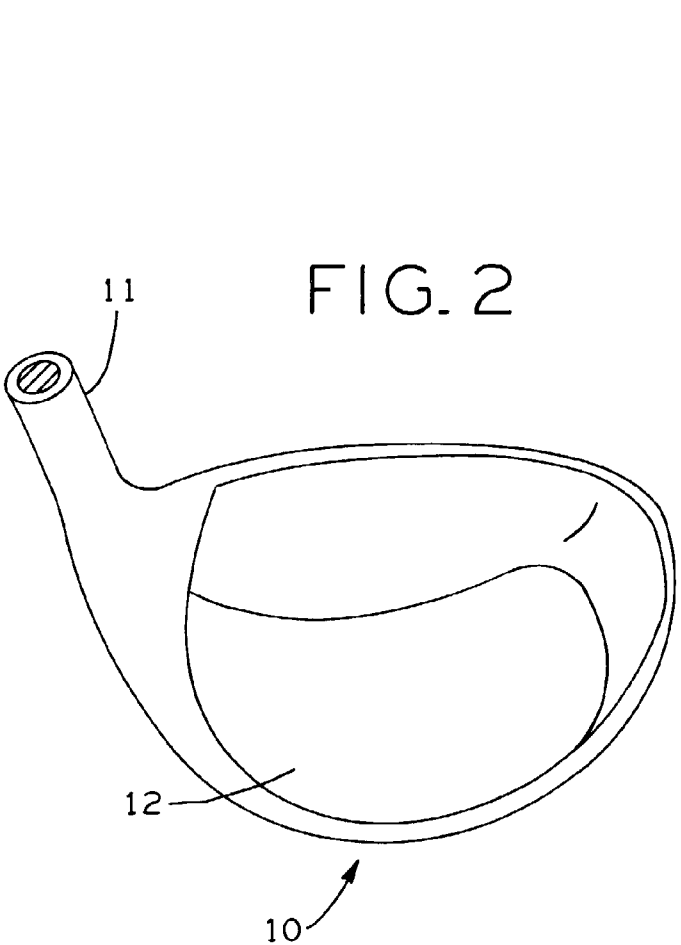
FIG. 2 illustrates a view from the top of the body portion of the golf club head of the present invention.

The forging method used is known as "impression" or "precision" forging. The body portion 10 of the golf club head is forged from a solid billet of material using impression dies. Preferably the billet of material is plastically deformed by the impression dies whilst heated to between 50% to 70% of the melting temperature of the material. The forging of the body portion of the golf club head preferably includes the following steps:

(i) the preparation of a cylindrical billet of metal material;

(ii) the application of a protective and/or lubricating coating to the billet (optional);

(iii) the heating of the billet to the desired forging temperature;

(iv) the impression forging of the billet into a first, "preform", shape;

(v) the application of a protective and/or lubricating coating to the preform shape (optional);

(vi) the heating of the preform shape to the desired forging temperature;

(vii) the impression forging the preform shape to the final, "precision", shape;

(viii) the trimming of the "flash" material from the final forged shape;

(ix) the chemical milling or etching of the forging to the required weight.

Each of these steps will now be described in further detail:

(i) Preparation of Raw Stock Material Into a Cylindrical Billet

The raw material is typically turned or ground into a cylindrical billet of the appropriate diameter and length to provide the desired volume of material for the forging process, The billet normally includes 10% to 20% more volume of material than the finished forging.

(ii) Application of a Protective and/or Lubricating Coating to the Billet (Optional)

The billet may be coated with a lubricant and/or protective coating prior to heating. Alternatively, the lubricant may be added to the forging die rather than the billet. The coating depends largely on the material being forged and is not essential for all materials. For example, titanium requires a protective coating in order to prevent contamination with the atmosphere when the material is heated to a temperature greater than 600 degrees celsius.

(iii) Heating of the Billet to the Desired Forging Temperature

This step is normally performed in an induction or convection furnace, with the billet being heated to between 50% to 70% of the melting temperature of the material.

(iv) Forging of the Billet Into a First, "Preform", Shape

This preforming step accounts for approximately 20% of the total plastic material flow from the cylindrical billet to the final shape. The function of the preforming operation is to redistribute the billet material for the final forging operation without overstressing the material in either forging operation.

The preforming operation is an impression die forging process similar to the final forging operation. It is normally performed at a pressure of around 500 tonnes for a No. 1 driver club head.

(v) Application of a Protective and/or Lubricating Coating to the Preform Shape (Optional)

The preform forging may be coated with a lubricant and/or protective coating prior to heating. Alternatively, the lubricant may be added to the forging die rather than the preform forging. As mentioned above, the need for such a coating depends largely on the material being forged.

(vi) Heating of the Preform Forging to the Desired Forging Temperature

This step forms part of the final forging operation and is normally performed in an induction or convection furnace adjacent to the forging press. The preform forging is heated to between 50% to 70% of the melting temperature of the material.

(vii) Forging the Preform Shape Into the Final Shape

The final forging step uses precision or impression dies. This normally consists of two die halves which, in combination, form an accurate impression of the final product shape. The dies are controlled by a forging press, typically but not exclusively mechanical.

Preferably a first die is stationary and is connected to a main press frame. This die has limited adjustment for setting purposes only. A second die is attached to a moving platen of the press. The heated preform shape is placed in the cavity of the first die whilst the second die is retracted and stationary. The press then moves the second die towards the first die under high force and speed. The impact energy of the second die hitting the heated preform causes plastic deformation of the preform and the filling of both the first and second dies. Some material is forced out of the dies through purpose designed "flash" lines. This flash is later removed in the trimming operation. The production of flash ensures the complete filling of the dies.

Upon the second die reaching a bottom dead centre position it is then immediately retracted to its stationary position. The finished forged part is then removed from the die. A typical forging cycle is around 10 seconds, including loading and unloading. Heating time is extra.

(viii) Trim "Flash" from Forging

Upon removal from the final forging die, the forging includes excess material or "flash". Whilst the forging is still hot it is trimmed of this flash.

Preferably the trimming operation is similar to the blanking of sheet metal. Trimming occurs by means of a three dimensional tool with a cavity and a punch. Preferably the die cavity is attached to a press frame and the punch is attached to an upper ram. The hot forging is placed into the die cavity and the punch pushes the forging through the die thereby shearing the flash from the forging. The forging is then allowed to cool.

(ix) Chemically Mill or Etch Forging to the Required Weight

Upon cooling, the forging may then be blasted, brushed or tumbled to remove the protective/lubricant coating. The forged club head may then be chemically milled or etched to the required weight specification. Typically a finished golf club head has a weight tolerance of 5% of its total weight.

Figure 1:
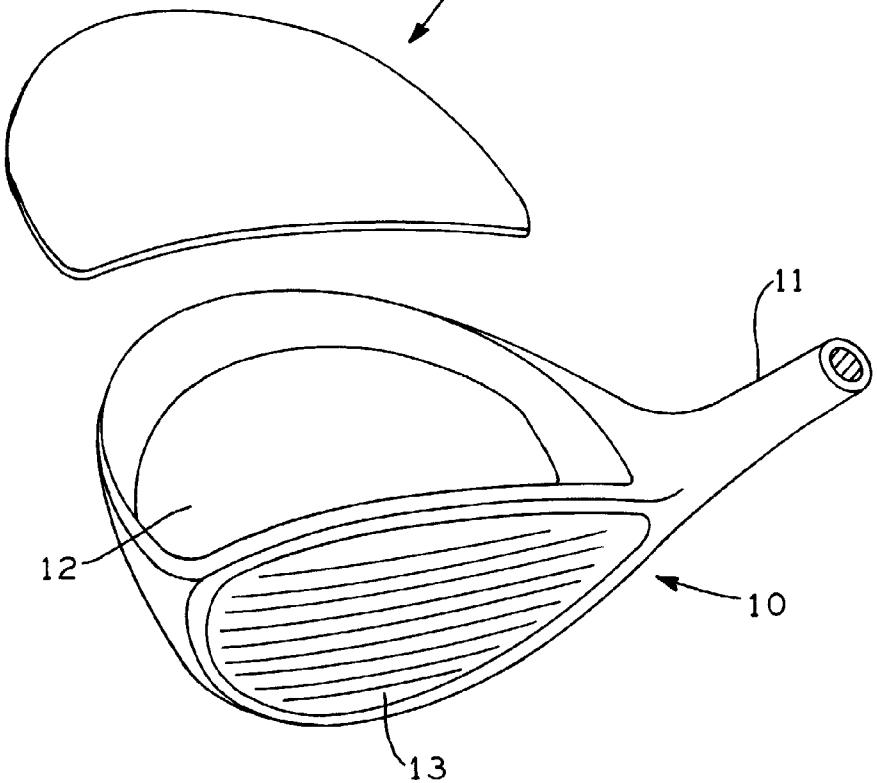
FIG. 1 illustrates a perspective view of a preferred embodiment of the golf club head of the present invention.

Referring to FIG. 1, a perspective view of the body portion, 10, of the golf club head produced by the method of the present invention is illustrated. The body portion 10, comprises an integrally formed hosed 11, hitting face 13 and sole portion 12. As indicated previously, by having each of these features forged in one-piece greater control over the relative positions between each of the components is achieved.

Furthermore, it is observed that by having each of the features of the hosel 11, the hitting face 13 and the sole portion 12 forged in one piece, the integral strength of the one piece body portion 10 allows substantially all the mass of the club head to be the "effective mass" which contributes to the transfer of energy from the player to the ball for greater feel, accuracy and distance. It is also observed that as a consequence of the forging process the effective mass of the club head is low in relation to its overall mass, thus providing a very low centre of gravity.

During the impression forging of the body portion 10 the metal material flows under high pressure from the sole portion 12 to the hitting face 13, then to the outer rim of the main portion and finally to the hosel portion 11. This plastic material flow during the forging step results in providing the body portion of the club head with optimum strength characteristics during energy distribution as the club head strikes the golf ball. Grain flow, size and composition are precisely controlled.

Of particular importance is the Junction of the hitting face and the sole of the club head. This zone is subject to high stresses during the impact of the club head with a golf ball. With club heads where the body portion is made from a number of separate pieces this junction comprises a welded joint. This results in less than desirable material properties in this zone and creates a stress concentration. In particular, there is a discontinuity in the material properties at the joint. However, with the present invention the hitting face and sole of the club head are forged as one piece which results in a continuous material flow at the junction between the hitting face and the sole of the club head. This in turn provides improved material properties in this zone of the club head.

Furthermore, forging of the body portion of the club head permits the flexibility to change the relative relationships between each of the components in the one piece body if necessary. Furthermore by producing a two piece metal wood head by forging, this reduces the amount of welding required reducing greatly the need for grinding and polishing, thus controlling structural wall thickness on all external surfaces. Also by eliminating the need for welding of the body portion of the club head, the club head is of a more sound construction when compared to a welded club head where failure is more likely to occur. Furthermore as indicated previously, since the effective mass is substantially in the hitting face and the sole portion of the wood head, when the head is made of titanium, aluminium or alloys thereof, this allows for the mass to be distributed to a position lower and forward in the club so as to improve the moment of inertia of the club head.

The bore of the hosel 11 is provided by a drilling operation.

The top, or crown, portion 20 of the club head may be made by casting or from pressed sheet metal. The crown 20 is preferably fixed onto the body portion 10 by welding.

The head can be filled, either before the top is affixed or after, using any known techniques and fillers such as polyurethane foam, etc. The golf club head is finished in the conventional manner.

Thus the present invention provides an improved method of manufacturing a metal wood golf club head and furthermore a novel metal wood golf club head with surprisingly improved performance and in particular improved strength and greater feel, accuracy and hitting distance for the user.

What is claimed is:

1. A method of manufacturing a metal wood golf club head, including the steps of:

(i) heating a billet of metal to a temperature of between 50% to 70% of the melting temperature of the metal;

(ii) impression forging the billet while heated to said temperature to form a first preform shape;

(iii) heating the preform shape to a temperature of between 50% to 70% of the melting temperature of the metal; and (iv) impression forging the preform shape while heated to said temperature to form a one piece body portion of the club head including a hosel, a sole and a hitting face.

2. A method according to claim 1, wherein the billet of metal is aluminum or an aluminum alloy.

3. A method according to claim 2, wherein the billet of metal is 7075 aluminum alloy.

4. A method according to claim 1, wherein the billet of metal is titanium or a titanium alloy.

5. A method according to claim 1, wherein a crown portion is welded to an edge region of the one piece body portion to form said metal wood golf club head.

6. A method according to claim 1, wherein the hitting face of the one piece body portion is machined after impression forging the preform shape.

7. A method according to claim 6, wherein the hitting face of the one piece body portion is machined by way of computer numerical controlled (CNC) milling.

8. A method according to claim 7, wherein the hitting face of the one piece body portion is machined to within a tolerance of ±0.03 millimeters.

9. A method according to claim 8, wherein loft, lie and face angles of the golf club head are controlled to within a tolerance of ±0.25 degrees.

10. A method according to claim 5, wherein the hitting face of the one piece body portion is machined after impression forging the preform shape.

11. A method according to claim 10, wherein the hitting face of the one piece body portion is machined by way of computer numerical controlled (CNC) milling.

12. A method according to claim 11, wherein the hitting face of the one piece body portion is machined to within a tolerance of ±0.03 millimeters.

13. A method according to claim 12, wherein loft, lie and face angles of the golf club head are controlled to within a tolerance of ±0.25 degrees.

* * * * *